United States Patent [19]

O'Tousa et al.

[11] Patent Number: 5,034,093

[45] Date of Patent: Jul. 23, 1991

[54] METAL ETCHING COMPOSITION

[75] Inventors: Joseph E. O'Tousa, Northridge; Clark S. Thomas, Woodland Hills; Robert E. Foster, Ben Lomond, all of Calif.

[73] Assignee: The United States of America as represented by the Administrator of the National Aeronautics and Space Administration, Washington, D.C.

[21] Appl. No.: 587,890

[22] Filed: Sep. 25, 1990

[51] Int. Cl.[5] ..... B44C 1/22; C23F 1/00; C09K 13/00

[52] U.S. Cl. ..... 156/664; 156/656; 252/79.2; 252/79.4

[58] Field of Search ..... 156/656, 664, 665; 252/79.2, 79.4

[56] References Cited

U.S. PATENT DOCUMENTS 4,944,807 7/1990 Sova ..... 252/79.4 X
4,970,015 11/1990 Garcia ..... 252/79.4

*Primary Examiner*—William A. Powell
*Attorney, Agent, or Firm*—Robert L. Broad, Jr.; Jerry L. Seemann

[57] ABSTRACT

The present invention is directed to a chemical etching composition for etching metals or metallic alloys. The composition includes a solution of hydrochloric acid, phosphoric acid, ethylene glycol and an oxidizing agent. The etching composition is particularly useful for etching metal surfaces in preparation for subsequent fluorescent penetrant inspection.

12 Claims, No Drawings

METAL ETCHING COMPOSITION

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

FIELD OF THE INVENTION

The present invention is directed generally to a composition for etching metals or metallic alloys. More particularly, the present invention is directed to a metal or metallic alloy etching composition comprising a solution of hydrochloric acid, phosphoric acid, ethylene glycol and an oxidizing agent. Most specifically, the present invention is directed to a composition for etching metal or metallic alloys prior to penetrant inspection of the metal or metallic alloys comprising a solution of hydrochloric acid, phosphoric acid, ethylene glycol and ferric chloride.

BACKGROUND OF THE INVENTION

Chemical etching, in a metallurgical sense, can be defined as a method for revealing structural details by the preferential attack of a metal surface with a chemical agent having a different effect on various alloy constituents. Many purposes for subjecting a metallic surface to an etching process are known and commonly practiced, including the inspection of metals for structural surface imperfections.

One test utilized for non-destructive detection of minute surface flaws and defects in metals is fluorescent penetrant inspection. This test includes applying to a metal surface a fluorescent liquid penetrant which enters into surface discontinuities or defects, removing any excess penetrant from the surface, and identifying the defect location by the emission of visible fluorescent light emitted by the retained penetrant upon exposure to ultraviolet light.

Prior to employing this process, it is necessary to chemically etch the metallic surface to remove any metal which, due to processes such as machining or grinding, has smeared over the surface and therefore masked possible flaws. These flaws, during subsequent processing or use of the metal, may propagate and cause premature failure if undetected. The etchant utilized in this treatment step must remove the surface metal within a prescribed time but must not attack grain boundaries or overetch the surface, thereby making the surface inadequate for accurate fluorescent penetrant inspection.

A commonly utilized pre-penetrant etchant includes a mixture of 50% hydrochloric acid and 50% hydrogen peroxide; however, this etchant has many serious drawbacks. Initially, use of the $HCl/H_2O_2$ etchant often produces etch-induced artifacts, such as pitting of the metal hardware surface. Subsequent penetrant inspection and detection of these etch-induced flaws results in rejection of the metal hardware and subsequent reworking the hardware to remove the flaws.

A disadvantage related to the 50% HCl - 50% $H_2O_2$ etch is the volatile, unstable nature of the etchant composition itself. Because of this instability, the mixture must be formed immediately prior to use in a metal shop where shop personnel may not accurately prepare the mixture. The result is an imperfect concentration ratio which will greatly affect the etching process and cause the drawbacks caused above.

A clear need exists for an etchant composition which can be produced easily and quickly, which is storable, stable and has a long shelf life and which, when used prior to a penetrant inspection testing method, provides a surface acceptable for penetrant inspection without inducing additional flaws.

OBJECTS AND SUMMARY OF THE INVENTION

It is an object of the present invention to provide an effective etchant composition.

It is a further object of the present invention to provide a composition for etching metal or metallic alloy surfaces.

It is another object of the present invention to provide an etchant composition which is storable and has a long, stable shelf life.

It is still another object of the present invention to provide an etchant composition suitable for use in conjunction with conventional fluorescent penetrant inspection methods.

In accordance with the present invention, an etching composition, including hydrochloric acid, phosphoric acid, ethylene glycol and an oxidizing agent is provided. Use of this composition eliminates the rejection of metal articles based on penetrant inspection testing for artifacts induced by the etching process. Etching with the composition of the present invention provides an adequate surface for penetrant inspection without overetching the surface. The result is improved interpretation accuracy of penetrant artifacts and a decreased number of rejected surfaces by eliminating any ambiguity as to whether the penetrant artifacts were etch induced.

The composition of the present invention further exhibits a high level of stability after formation. The composition of the present invention can therefore be formulated in a laboratory or other chemical manufacturing facility, stored indefinitely and shipped to other locations when necessary. This eliminates the inconveniences, inefficiencies and inaccuracies of formulating of the etchant immediately prior to the etching process.

DESCRIPTION OF THE PREFERRED EMBODIMENT

The composition of the present invention preferably comprises ferric chloride, hydrochloric acid, phosphoric acid and ethylene glycol. In the etching composition, ferric chloride serves as a oxidizing agent, hydrochloric acid as a corrosive agent, phosphoric acid as a leveling agent and ethylene glycol as a modifier to reduce ionization. Other oxidizing agents, including cupric chloride, can be utilized in lieu of or in addition to ferric chloride.

More specifically, the composition comprises from about 65-75 volume percent hydrochloric acid, 20 to 30 volume percent ethylene glycol and 3 to 10 volume percent phosphoric acid, with the percentages being based on the total volume of hydrochloric acid, phosphoric acid and ethylene glycol.

Ferric chloride is present in an amount in the range of 150-250 grams (based on ferric chloride hexahydrate) per liter of the hydrochloric acid/phosphoric acid/ethylene glycol admixture. Most preferably, the composition comprises a solution of 71 volume percent hydrochloric acid, 23 volume percent ethylene glycol, 6 volume percent phosphoric acid and 190 grams ferric chloride (on a ferric chloride hexahydrate basis) per 1 liter of solution.

The hydrochloric acid is preferably reagent grade while the phosphoric acid is preferably reagent grade or food grade.

The composition of the present invention can be easily and simply formulated by combining the ingredients in any appropriate manner. Preferably, the composition is formulated by first combining the hydrochloric acid with the oxidizing agent. After the oxidizing agent is completely dissolved, the phosphoric acid and the ethylene glycol liquid components are added while stirring the solution so that a homogenous mixture is achieved.

The use of the composition of the present invention and its performance in the etching process is shown in the following example.

EXAMPLE 1

A thin groove was machined in the top face of a metallic alloy ring and was filled with INCOLOY® 903 weld metal. INCOLOY® is a registered trademark of the International Nickel Company. The INCOLOY® 903 alloy includes the following alloying constituents and nominal percentage values:

| | |
|---|---|
| Iron | 42.0 |
| Nickel | 38.0 |
| Cobalt | 15.0 |
| Columbium | 3.0 |
| Titanium | 1.4 |
| Aluminum | 0.7 |

This overlay was completed using robotic welding. The weldment was then low stressed machined in a conventional manner. After machining, a section of the weldment was wet polished with 600 grit wet-or-dry silicon carbide papers. One section of the ring was penetrant inspected in the as-received condition to determine a baseline for the evaluation. Approximately one inch segments along the ring circumference were masked off.

A pre-penetrant etchant solution having the composition defined in Table I was applied to the weldment area for periods of time in excess of 90 seconds. The etched surface area was examined up to 80× using a stereomacroscope. After evaluation, the specimens were penetrant inspected and evaluated. The process was duplicated for varied weldment surface and heat treatment conditions. The surface conditions tested included as-machined, polished with 600 grit wet-or-dry silicon carbide paper, and polished to less than one micron finish in the laboratory. The physical properties tested included aswelded, stress relieved and heat treated and aged.

The results of this testing are provided in Table I. For all tested treatment times it is observed that all smeared metal is completely removed and the surface is acceptable for fluorescent penetrant inspection.

TABLE I

| | 80 gms $FeCl_3$<br>300 ml HCl<br>25 ml $H_3PO_4$<br>100 ml Ethylene Glycol | |
|---|---|---|
| 903 OVERLAY | Treatment time (sec) | Surface Condition |
| AS WELDED | 90 | Satisfactory |
| POLISHED W/600 PAPER | 120 | Satisfactory |
| AS WELDED | 120 | Satisfactory |
| MACHINED 32 FINISH | 180 | Satisfactory |
| STRESS | 120 | Satisfactory |
| RELIEVED | 180 | Satisfactory |
| HEAT TREAT | 120 | Satisfactory |
| AND | 180 | Satisfactory |
| AGED | 210 | Satisfactory |

While the etchant composition of the present invention has been described in detail, it is to be understood that various changes and modifications which do not depart from the spirit and scope of the present invention may be made. For example, the composition may utilize for etching a variety of surfaces, including but not limited to micropolished surfaces, surfaces polished with 600 silicon carbide paper and machined surfaces having a 32 RMS finish.

I claim:

1. An etchinq composition comprising a solution of hydrochloric acid, phosphoric acid, ethylene glycol and an oxidizing agent, said hydrochloric acid being present in an amount ranging from about 65 to 75 percent by volume.

2. The etching composition of claim 1 wherein said oxidizing agent comprises ferric chloride.

3. The etching composition of claim 1 wherein said ethylene glycol is present in an amount ranging from about 20 to about 30 percent by volume.

4. The etching composition of claim 1 wherein said phosphoric acid is present in an amount ranging from about 3 to about 10 percent by volume.

5. The etching composition of claim 2 wherein said ferric chloride is present in said composition in an amount of about 150 to about 250 grams, based on ferric chloride hexahydrate, per liter of solution.

6. The etching composition of claim 2 comprising about 71 percent by volume of hydrochloric acid, about 23 percent by volume of ethylene glycol, about 6 percent by volume of phosphoric acid and about 190 grams ferric chloride, based on ferric chloride hexahydrate, per liter of solution.

7. A method for etching metallic surfaces comprising applying to said metallic surface an etchant composition comprising a solution of hydrochloric acid, ethylene glycol, phosphoric acid and an oxidizing agent, said hydrochloric acid being present in an amount ranging from about 60 to 75 percent by volume.

8. The method of claim 7 wherein said oxidizing agent comprises ferric chloride.

9. The method of claim 7 wherein said ethylene glycol is present in an amount ranging from about 20 to about 30 percent by volume.

10. The method of claim 7 wherein said phosphoric acid is present in an amount ranging from 3 to about 10 percent by volume.

11. The method of claim 8 wherein said ferric chloride is present in said composition in an amount of about 150 to 250 grams, based on ferric chloride hexahydrate, per liter of solution.

12. The method of claim 8 wherein said etchant composition comprises about 71 percent by volume of hydrochloric acid, about 23 percent by volume of ethylene glycol, about 6 percent by volume of phosphoric acid and about 190 grams ferric chloride based on ferric chloride hexahydrate, per liter of solution.

* * * * *